US005720447A

United States Patent [19]

Brechko

[11] Patent Number: 5,720,447

[45] Date of Patent: Feb. 24, 1998

[54] SELF COMPENSATING SUPPLY ROLL SUPPORT FRAME WEB GUIDING SYSTEM

[75] Inventor: Michael Richard Brechko, Windsor, N.Y.

[73] Assignee: Azon Corp., Johnson City, N.Y.

[21] Appl. No.: 593,505

[22] Filed: Jan. 30, 1996

[51] Int. Cl.[6] ..... B65H 26/06

[52] U.S. Cl. ..... 242/563.1; 242/566; 242/598

[58] Field of Search ..... 242/422.4, 563.1, 242/566, 592, 598.1, 598.5, 598; 226/15, 18

[56] References Cited

U.S. PATENT DOCUMENTS

| | | | |
|---|---|---|---|
| 1,904,394 | 4/1933 | Vacher | 242/592 X |
| 2,637,504 | 5/1953 | Blessing | 242/422.4 |
| 2,722,415 | 11/1955 | Wood, Jr. . | |
| 2,797,091 | 6/1957 | Fife . | |
| 2,989,265 | 6/1961 | Selsted | 242/563.1 X |
| 3,107,036 | 10/1963 | Richards et al. . | |
| 3,322,362 | 5/1967 | Nordgren | 242/563.1 |
| 3,625,447 | 12/1971 | Hank | 242/422.4 X |
| 4,174,171 | 11/1979 | Hamaker et al. . | |
| 4,384,686 | 5/1983 | Wiley et al. | 242/563.1 |
| 4,923,139 | 5/1990 | Bulso, Jr. et al. | 242/563.1 |
| 5,085,918 | 2/1992 | Rajan et al. . | |

FOREIGN PATENT DOCUMENTS

| | | | |
|---|---|---|---|
| 4144860 | 5/1992 | Japan | 242/598.1 |
| 129293 | 8/1950 | Sweden | 242/598.5 |

*Primary Examiner*—Daniel P. Stodola
*Assistant Examiner*—William A. Rivera
*Attorney, Agent, or Firm*—Crummy, Del Deo, Dolan, Griffinger & Vecchione

[57] ABSTRACT

A web guiding device for directing sheet material from a supply roll into a processing machine along a predetermined track in a manner that corrects for tracking errors caused by side edge-to-side edge variations in the force needed to draw the sheet material from the supply roll. The web guiding device includes a support frame that retains the supply roll in a manner that enables the supply roll to freely rotate about its mid-axis as the sheet material is drawn from the supply roll. The support structure is pivotably mounted to a bracket structure that couples the support structure to the processing machine. At least one guide element is provided on the bracket structure for orienting the sheet material onto the predetermined track prior to the sheet material being received by the processing machine. The support frame and the supply roll are canted when a side edge-to-side edge variation is experienced in the force needed to draw the sheet material from the supply roll. The canting of the supply structure at least partially compensates for the side edge-to-side edge force variations experienced, thereby helping to maintain the sheet material on the predetermined track.

10 Claims, 4 Drawing Sheets

SELF COMPENSATING SUPPLY ROLL SUPPORT FRAME WEB GUIDING SYSTEM

FIELD OF THE INVENTION

The present invention relates generally to guide devices and methods that direct a sheet of web material from a wound roll into a processing machine, thereby preventing the position of the web material from varying significantly with respect to the processing machine. More specifically, the present invention relates to a guide device and method for directing a wound media web through a multi-station color printer, thereby ensuring that variations in the wound media web do not produce misregistrations during the printing of separate colors.

BACKGROUND OF THE INVENTION

Many manufacturing processes utilize machinery adapted to receive wound rolls of web material. Materials such as paper, fabric, film printing laminates, sheet plastic and the like are commonly shipped wound onto large rolls. These rolls are then loaded onto various types of manufacturing machines that pull the web material from the large roll for processing. Many machines require that the web material be fed into the machine along a known track. As such, the position of the web material within the machine is known and the manufacturing process being performed by the machine is accurately applied to the web material.

A large problem with many manufacturing processes that use wound web material is that the web material tends to wander away from a straight track as the web material is dram from a roll. There are many factors that cause a wound web material to wander off track as it leaves a roll. For example, if there are side-to-side variations in the web material when it is wound into a roll, then those side-to-side variations would cause the web material to unwind in an uneven fashion and therefore wander away from a single straight track. Similarly, variations in thickness of the web material also cause side-to-side tension variations when the web material is wound onto a roll. Consequently, deviations in the process of winding a web material onto a roll and deviations in the thickness of the web material itself both cause the web material to wander when unwound. Even for web materials that are manufactured and wound to exact tolerances, there are problems with off-track wandering. As rolls of web material are packaged, shipped, unpacked and loaded onto a machine, a small degree of telescoping can easily occur. The telescoping causes the web material to change position as it is unwound, thereby altering the track of the web material.

In many processes, slight variations in the track of the web material can be tolerated. However, in some applications, even small variations in the web material tracking are unacceptable. One such application is when material is fed through a color printer with a different printing station for each color. In such an application, dots of colored ink are deposited at distinct pixel points to produce the overall color image. If the web material wanders between printing stations, colors may be deposited on top of one another or in the wrong pixel point, thereby producing an image that is miscolored, blurry or otherwise of poor quality.

A specific example of where such printing problems have been experienced is in the manufacture of modem license plates. Many license plates contain multi-color images that are printed on a web material that is later laminated onto an aluminum plate. The multi-color images are printed on the web material by passing the web material through a color printer with different color printing stations. Poor tracking of the web material results in dot-to-dot misregistration between the multiple printing stations. In addition to the misalignment errors from one printing station to another, the overall misalignment caused by the poor tracking causes problems in aligning the printed image with the metal plate during the lamination process. A prior art processing technique for printing a multi-color image on a web material and laminating the multi-color image to a license plate is described in U.S. Pat. No. 5,085,918 to Rajan et al., entitled PRINTED RETROREFLECTIVE SHEET, issued Feb. 4, 1992.

In the prior art, there have been devices developed to minimize the degree of wandering experienced by a web material as it is unwound from a roll. Such a prior art device is exemplified by U.S. Pat. No. 3,107,036 to Richards et al., entitled SELF-ADJUSTING WEB GUIDING APPARATUS. The Richards patent shows a web guide with two rollers. One roller is spring loaded to be adjustable laterally while the second roller is spring loaded to change pitch with respect to the horizontal. The two roller system of Richards includes a large number of manual adjustments that must be custom set for a given application.

Another approach to correcting web material tracking is shown in U.S. Pat. No. 4,174,171 to Hamaker et al., entitled BELT TRACKING SYSTEM. The Hamaker patent is exemplary of prior art devices that electronically monitor the position of the web material and electronically alter the position of at least one roller when poor web material tracking is detected.

The prior art, as exemplified by both the Hamaker patent and the Richards patent, contains devices that require significant modifications to an existing piece of equipment in order for the prior art device to be used. A need therefore exists in the prior art for a device that can be easily retro-fitted to an existing piece of equipment, wherein that device corrects poor tracking in an inexpensive manner without the need for electronic monitoring sensors or multiple manual adjustments. This need is met by the present invention as set forth below.

SUMMARY OF THE INVENTION

The present invention is a device for directing sheet material from a supply roll into a processing machine along a predetermined track in a manner that corrects for tracking errors caused by side edge-to-side edge variations in the force needed to draw the sheet material from the supply roll. The present invention includes a support frame that retains the supply roll in a manner that enables the supply roll to freely rotate about its mid-axis as the sheet material is drawn from the supply roll. The support structure is pivotably mounted to a bracket structure that couples the support structure to the processing machine. At least one guide element is provided on the bracket structure for orienting the sheet material onto the predetermined track prior to the sheet material being received by the processing machine. A canting means is provided for canting the support frame and the supply roll when a side edge-to-side edge variation is experienced in the force needed to draw the sheet material from the supply roll. The canting of the supply structure at least partially compensates for the side edge-to-side edge force variations experienced, thereby helping to maintain the sheet material on the predetermined track. A lateral positioning means is also provided that enables the support frame and the supply roll to move laterally relative the bracket structure along a path parallel to the mid-axis of the supply roll. The lateral movement of the supply roll relative the bracket structure at least partially compensates for the side edge-to-side edge force variations and also compensates for any telescoping that may be present within the supply roll, thereby helping to maintain the sheet material on the predetermined track as it is fed into the processing machine. A friction structure is adapted to apply a drag to the supply roll as the sheet material is drawn.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF VARIOUS EMBODIMENTS

Although the present invention can be used to feed a roll of most any web material into a variety of different processing machines, the present invention is especially well suited for use in feeding printing media web material into a multi-station color printing machine. Accordingly, by way of example, the present invention will be described in conjunction with a multi-station color printing machine in order to set forth the best mode contemplated for the present invention.

Figure 1:
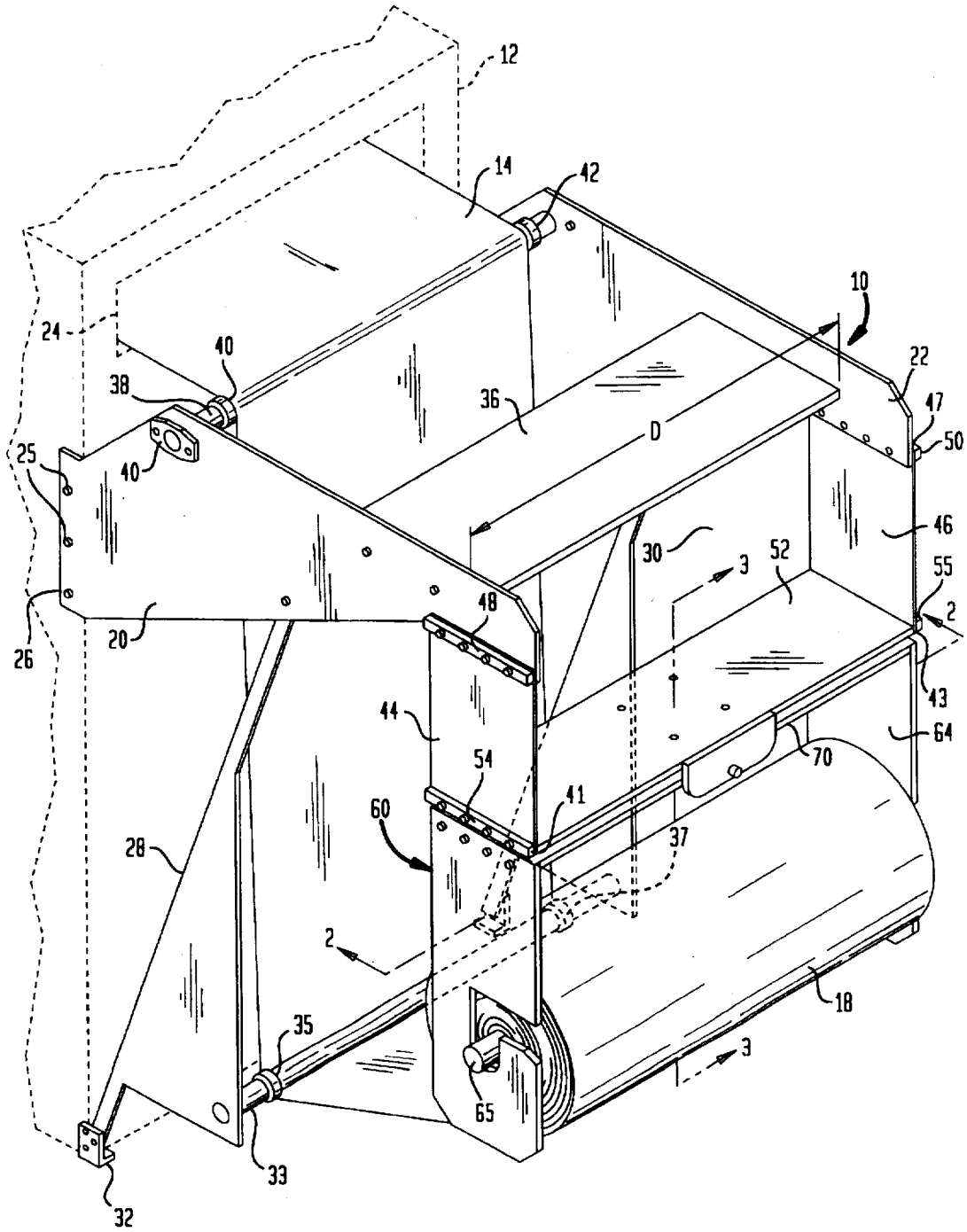
FIG. 1 is a perspective view of one preferred embodiment of the present invention web guiding device shown in conjunction with a roll of web material and mounted to a processing machine to facilitate further consideration and discussion.

Referring to FIG. 1, the present invention web guiding device 10 is shown coupled to a commercial multi-station color printer 12. In the shown embodiment, the multi-station color printer 12 is adapted to print upon a continuous sheet of printing media 14 that is fed into the multi-station color printer 12 from a large roll 18. The purpose of the present invention web guiding device 10 is to feed the printing media 14 from the large roll 18 into the multi-station color printer 12 in a manner that reduces lateral movement in the tracking of the printing media 14 as it travels through the multi-station color printer 12. The lateral movement in the tracking of the printing media 14 is caused by manufacturing variations present during the creation of the printing media 14 and the winding of the printing media 14 into the large roll 18. As a result, the degree of lateral movement experienced varies from roll to roll and from minute to minute on each roll.

In FIG. 1, it can be seen that the shown embodiment of the present invention web guiding device 10 contains two support brackets 20, 22 that attach to the multi-station color printer 12 on either side of the printing media feed port 24 associated with the multi-station color printer 12. The support brackets 20, 22 contain multiple apertures 25 at a first end 26 that enable the first end 26 of each support bracket 20, 22 to be bolted to the housing of the multi-station color printer 12. The support brackets 20, 22 support the weight of the remainder of the web guiding device 10 as well as the weight of the printing media roll 18. Two support struts 28, 30 are provided that help the support brackets 20, 22 support the significant weight of the large printing media roll 18. Each of the support struts 28, 30 is attached to one of the support brackets 20, 22 and extends downwardly to a base bracket 32 attached to the bottom of the multi-station color printer 12. As such, the support struts 28, 30 bear most of the weight of both the web guiding device 10 and printing media roll 18, thereby greatly reducing the load stresses at the first end 26 of each of the support brackets 20, 22.

A cross element 36 extends between the two support brackets 20, 22, thereby rigidly orienting the two support brackets 20, 22 in a parallel orientation a predetermined distance D apart. The predetermined distance D between the two support brackets 20, 22 is at least as wide as the widest sheet of printing media material capable of being processed by the multi-station color printer 12 and to allow for the width of the guides. An upper guide roller 38 is suspended between the two support brackets 20, 22 wherein the ends of the roller 38 pass into bearing blocks 39 bolted to the support brackets 20, 22. The upper guide roller 38 is free to rotate around its longitudinal axis and is oriented by the support brackets 20, 22 so that the top apex position of the guide roller 38 lays in the same horizontal plane as does the printing media feed port 24. Consequently, as the printing media 14 passes over the top of the roller 38, the printing media 14 is oriented into the same plane as the printing media feed port 24 on the multi-station color printer 12.

Guide collars 40, 42 are positioned on the upper guide roller 38 on either side of the printing media 14 passing over the upper guide roller 38. The guide collars 40, 42 are adjustable in position across the entire length of the upper guide roller 38. As such, the guide collars 40, 42 are capable of being brought to the edge of the printing media 14 being used regardless of the width of the printing media 14. The guide collars 40, 42 are positioned so as to orient the printing media 14 along a desired track as the printing media 14 passes over the upper guide roller 38 and is directed into the printing media feed port 24. For most applications, the guide collars 40, 42 are symmetrically disposed on either side of the center of the upper guide roller 38 and directs the printing media 14 down the center of the multi-station color printer 12.

A lower guide roller 33 is suspended between the support struts 28, 30 at a point below the upper guide roller 38. The lower guide roller 33 is oriented to be parallel to both the upper guide roller 38 and the central axis of the printing media roll 18. The lower guide roller 33 is positioned at a height lower than that of the printing media roll 18. As a result, the printing media 14 being drawn from the printing media roll 18 travels in a generally downward direction toward the lower guide roller 33, wherein the lower guide roller 33 reorients the printing media 14 and redirects it to the upper guide roller 38.

Guide collars 35, 37 are positioned on the lower guide roller 33 on either side of the printing media 14 passing over the lower guide roller 33. The guide collars 35, 37 are adjustable in position across the entire length of the lower guide roller 33. As such, the guide collars 35, 37 are capable of being brought to the edge of the printing media 14 being used regardless of the width of the printing media 14. The guide collars 35, 37 on the lower guide roller 33 are positioned to orient the printing media 14 onto a predetermined track with respect to the upper guide roller 38, regardless of variations in the position of the printing media 14 as it leaves the printing media roll 18.

Figure 2:
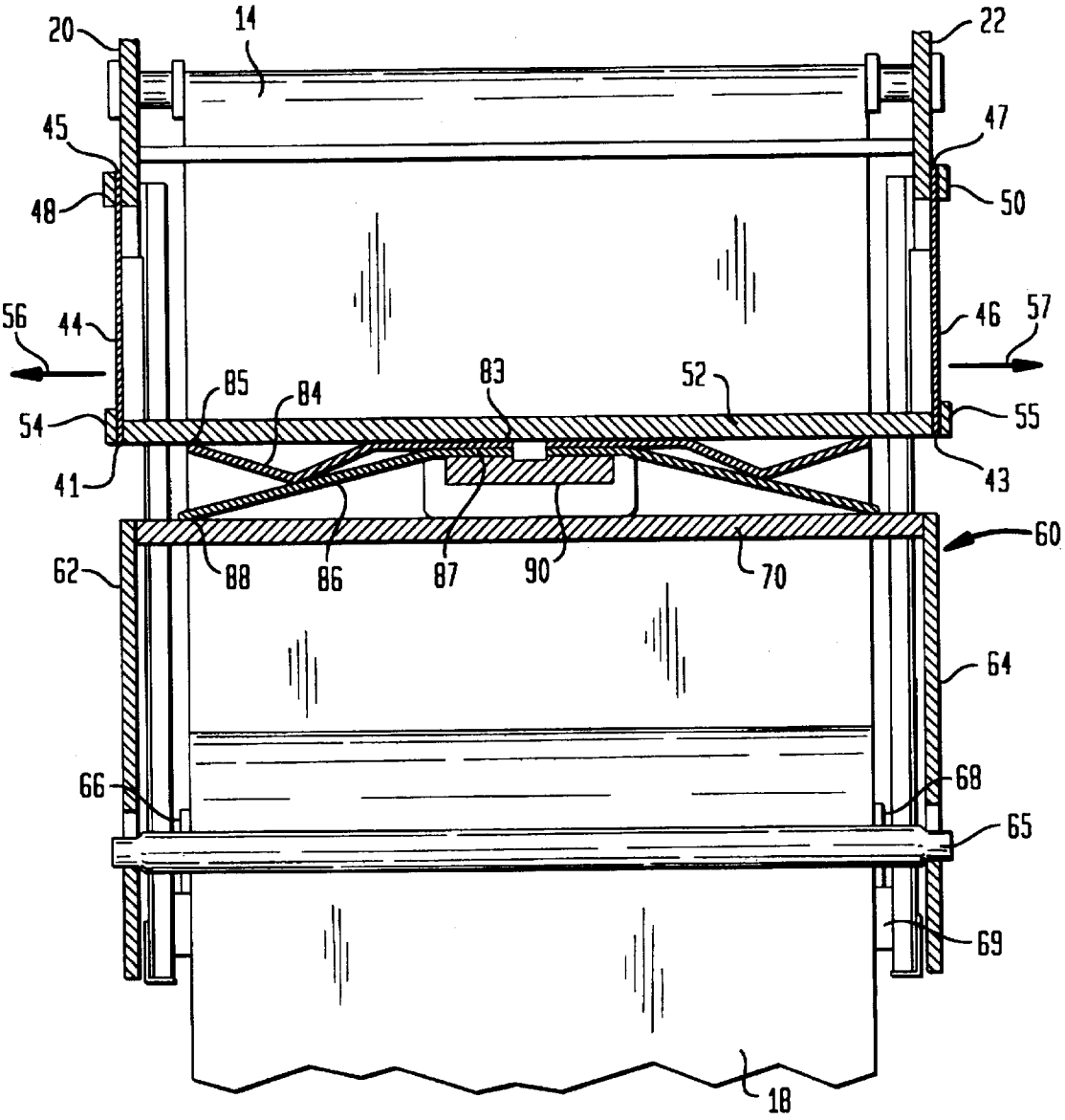
FIG. 2 is a cross-sectional view of the embodiment of FIG. 1, viewed along section line 2—2.

Referring to FIG. 2 in conjunction with FIG. 1, it can be seen that two spring plates 44, 46 extend downwardly from the support brackets 20, 22. The spring plates 44, 46 are thin pieces of metal, such as stainless steel or spring steel, that is capable of a wide range of elastic deformation. The top end 45, 47 of each of the spring plates 44, 46 is bolted between a compression plate 48, 50 and the support brackets 20, 22. As such, the top end 45, 47 of each spring plate 44, 46 is generally uniformly anchored to the support brackets 20, 22. The bottom end 41, 43 of each of the spring plates 44, 46 is anchored to a rigid base plate 52. The bottom end 41, 43 of each of the spring plates 44, 46 is bolted between a compression plate 54, 55 and the rigid base plate 52, thereby uniformly anchoring the spring plates 44, 46 to the rigid base plate 52.

The presence of the spring plates 44, 46 enables the base plate 52 to move laterally in the direction of arrows 56, 57 (FIG. 2), when a base plate 52 experiences a lateral force. The movement of the base plate 52 is enabled by the ability of the spring plates 44, 46 to laterally deform between their top ends 45, 47 and bottom ends 41, 43. When no lateral force is present, the spring constant of the spring plates 44, 46 causes the spring plates 44, 46 to return to their normal parallel orientation.

A roll suspension structure 60 is supported by the base plate 52. The roll suspension structure 60 consists of two hook-shaped arms 62, 64 that are adapted to receive the center shaft 65 of the printing media roll 18. An optional guide collar 66 (FIG. 2) passes over the center shaft 65 and abuts against the side of the priming media roll 18, thereby retaining the printing media roll 18 in a desired orientation relative the remainder of web guiding device 10 in general, especially the lower guide roller 33 (FIG. 1). Toothed gear collar 68 serves as a second guide and drives friction clutch 69. The friction clutch 69 self engages to maintain a tension on the printing media roll 18. While the friction clutch 69 is shown below the toothed gear collar 68, it may be equally well positioned in other orientations including but not limited to between the toothed gear collar 68 and the multistation color printer 12.

Figure 3:
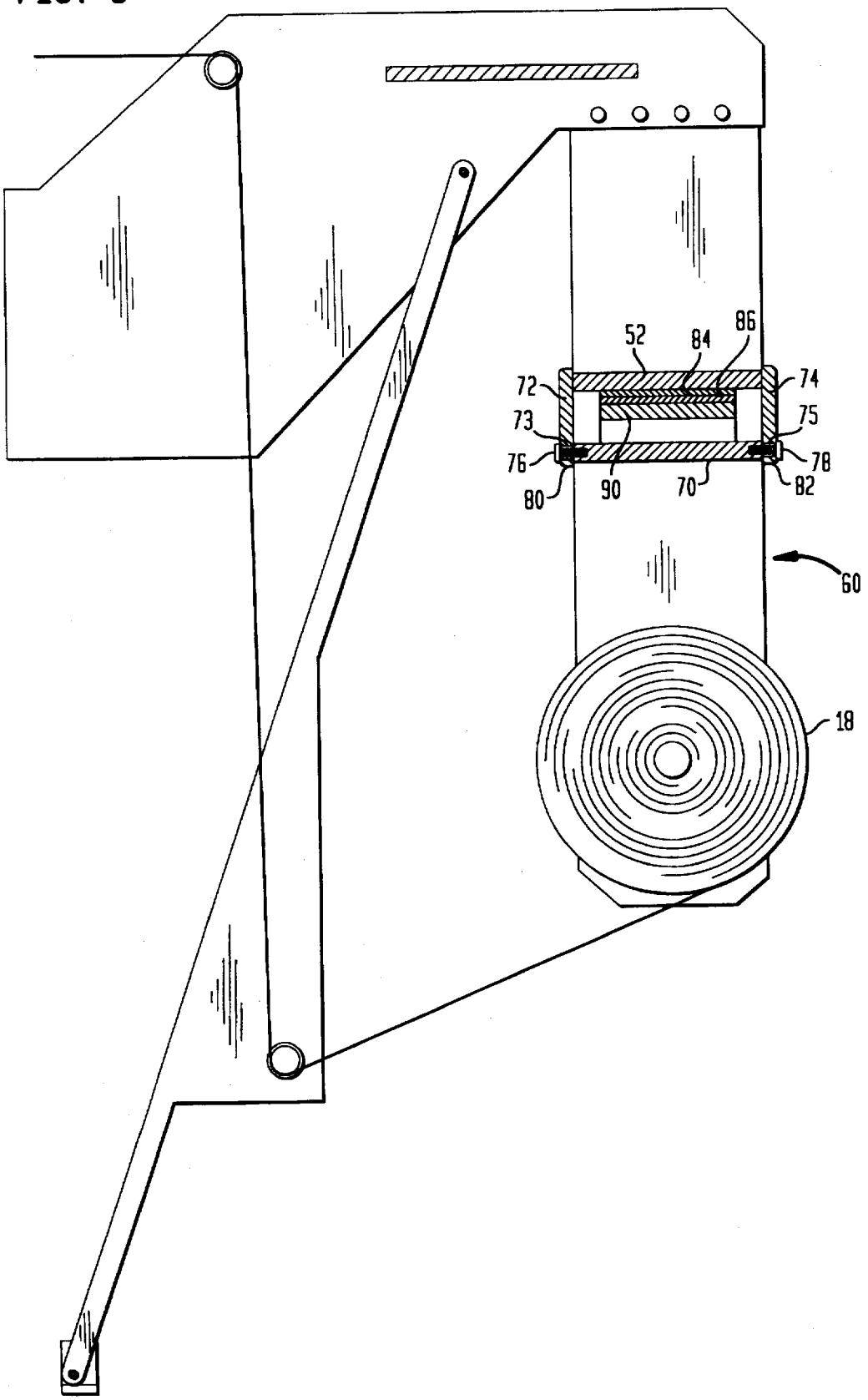
FIG. 3 is a cross-sectional view of the embodiment of FIG. 1, viewed along section line 3—3.

A rigid top plate 70 extends between the two hook-shaped arms 62, 64. The rigid top plate 70 maintains the two hook-shaped arms 62, 64 in a rigid orientation with respect to each other and to the top plate 70. Referring to FIG. 3, it can be seen that two pivot plates 72, 74 extend downwardly from the center of the base plate 52. Each of pivot plates 72, 74 provides a single pivot mounting hole 73, 75 that is positioned below the exact center of the base plate 52. Pivot bolts 76, 78 pass through the pivot mounting holes 73, 75 in the pivot plates 72, 74 and engage the exact center of the top plate 70 in the roll suspension structure 60. As such, the entire weight of the roll suspension structure 60 and the printing media roll 18 it supports is suspended by the pivot bolts 76, 78. The roll suspension structure 60 and the printing media roll 18 have a combined center of gravity that is positioned directly below the pivot bolts 76, 78, so that the roll suspension structure 60 and printing media roll 18 are balanced under the pivot bolts 76, 78. Bushings 80, 82 are provided that fit into the pivot mounting holes 73, 75 within the pivot plates 72, 74. The bushings 80, 82 prevent metal to metal contact between the pivot plates 72, 74 and the pivot bolts 76, 78 as the top plate 70 rocks back and forth about the central axis of the pivot bolts 76, 78.

Referring to FIG. 3 in conjunction with FIG. 2, it can be seen that spring elements 84, 86 extend downwardly from the bottom of the base plate 52 and engage the top surface of the roll suspension structure's top plate 70. In the shown embodiment, there are two types of spring elements used. The first spring element 84 is a leaf spring with a returning bend position between its first end 83 (FIG. 2) and its second end 85 (FIG. 2). The second spring element 86 is a leaf spring with a single obtuse bend disposed between its first end 87 (FIG. 2) and second end 88 (FIG. 2). Each first spring element 84 is stacked atop a second spring element 86 and is joined to the bottom of the base plate 52 by a clamping plate 90. The clamping plate 90 compresses the first end 87 of the second spring element 86 against the first end 83 of the first spring element 84 and compresses the first end 83 of the first spring element 84 against the bottom of the base plate 52.

The two spring elements 84, 86 are configured to provide a spring bias force between the base plate 52 and the top plate 70 of the roll suspension structure 60. The spring bias force is balanced on either side of the center of the top plate 70. As such, the spring bias force acts to maintain the top plate 70 of the roll suspension structure 60 in a parallel orientation with respect to the base plate 52.

Figure 4:
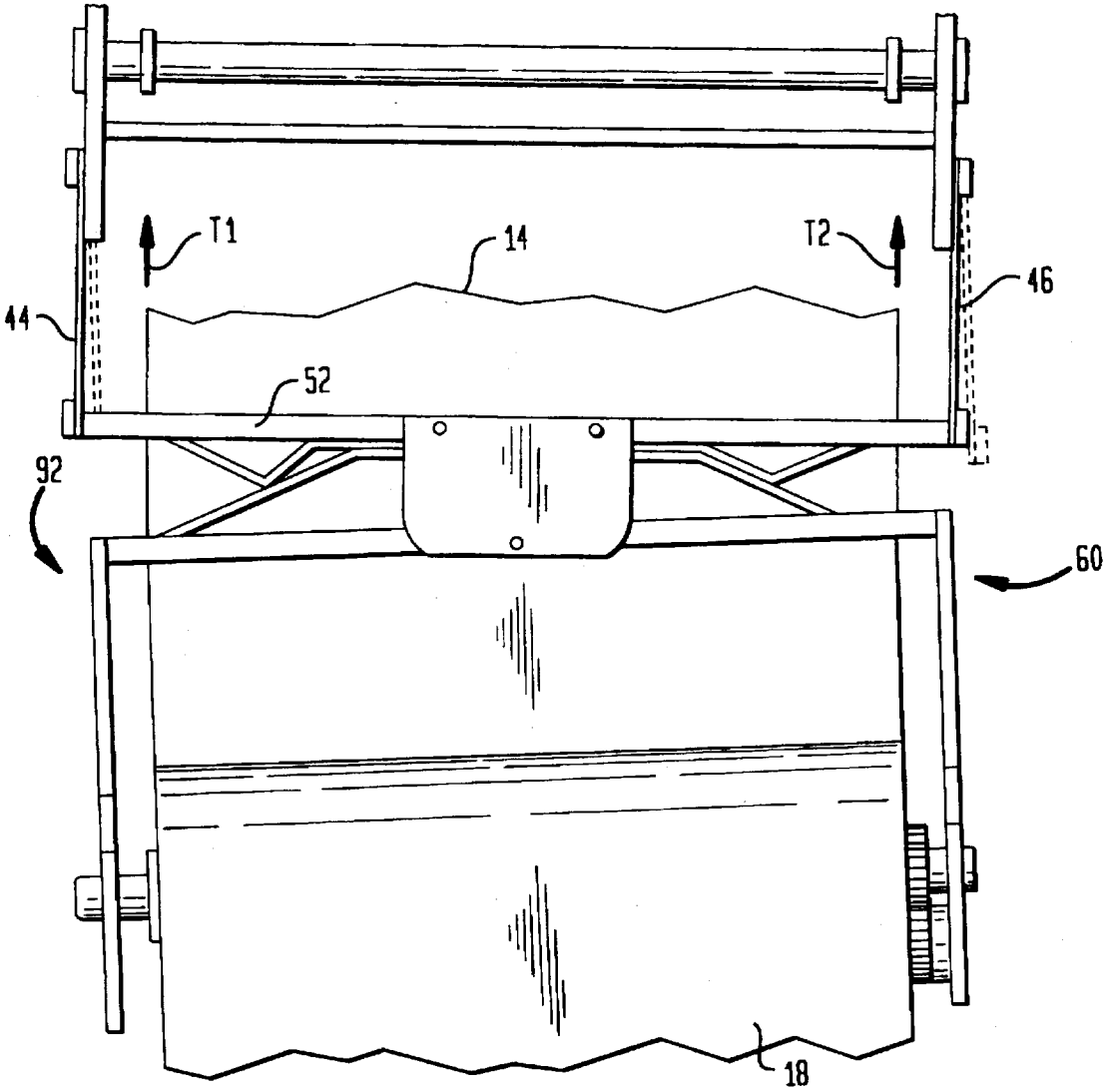
FIG. 4 is a front view of the embodiment of FIG. 1 shown in a canted position to illustrate the operation of the present invention web guiding device.

Once the printing media roll 18 is loaded onto the roll suspension structure 60 and the printing media 14 is fed into the multi-station printing machine, the top plate 70 of the roll suspension structure 60 remains parallel to the bottom of the base plate 52 as long as the side-to-side tension force needed to draw the printing media 14 from the printing media roll 18 remains substantially equal. However, if variations in the manufacture of the printing media roll 18 cause variations in the side-to-side tension force needed to unroll the printing media roll 18 then the uneven force would cause the balanced roll suspension structure 60 to canter about its central pivot support. Referring to FIG. 4, it can be seen that if the tension force T1 at the first side of the printing media 14 is greater than the tension force T2 at the second side of the printing media 14 as it is drawn from the roll 18, then the roll suspension structure 60 cants about the central pivot support in the direction of arrow 92. The canting of the roll suspension structure 60 causes an uneven force on the spring plates 44, 46 that support the base plate 52. The spring plates 44, 46 therefore deform, as indicated by the hidden lines, to compensate for the uneven force. The canting of the roll suspension structure 60 and the deformation of the spring plates 44, 46 compensate for the variations in the printing media roll 18 and enables the printing media 14 from the printing media roll 18 to be evenly fed into the multi-station printing machine.

In instances where the printing media 14 on the printing media roll 18 has telescoped but the side-to-side force needed to unwind the roll are generally even, the change in position of the printing media 14 unwinding from the printing media roll 18 also causes the roll suspension structure 60 to cant and the spring plates 44, 46 to deform. Again the canting of the roll suspension structure 60 and the deformation of the spring plates 44, 46 compensate for the positional variations in the telescoped printing media roll 18, thereby enabling the printing media roll 18 to be evenly fed into the multi-station printing machine.

Numerous modifications and alterative embodiments of the invention will be apparent of those skilled in the art in view of the foregoing description. For example, the leaf springs and spring plates used in the described embodiment can be substituted with coil springs or other spring elements capable of applying comparable spring bias forces. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed is:

1. A device for directing a sheet material from a supply roll into a processing machine along a predetermined track, comprising:

a support structure for supporting the supply roll in a manner that enables the supply roll to freely rotate about a mid-axis as the sheet material is drawn from the supply roll;

a bracket structure, adapted to be mounted to the processing machine, wherein said support structure is pivotably mounted to said bracket structure;

at least one guide element supported by said bracket structure, for orienting the sheet material drawn from the supply roll onto said predetermined track; and at least one spring element, disposed between said bracket structure and said support structure, for biasing said support structure into a first orientation wherein the mid-axis of the supply roll is substantially horizontal, whereby said support structure cants to a second orientation against the bias of said at least one spring element to maintain the sheet material on said predetermined track when an uneven force is required to draw the sheet material from the supply roll.

2. The device according to claim 1, further comprising a friction structure, adapted to apply a drag to the supply roll as the sheet material is drawn.

3. The device according to claim 1, wherein said support structure and the supply roll have a predetermined combined center of gravity and said support structure is pivotably coupled to said bracket structure at a point above said center of gravity.

4. The device according to claim 1, wherein said bracket structure includes at least one flexible element that enables said support structure supported by said bracket structure to move laterally along a path parallel to the mid-axis of the supply roll.

5. The device according to claim 4, wherein said at least one flexible element is a spring element that biases said support structure into a predetermined lateral orientation.

6. The device according to claim 4, wherein said bracket structure includes a rigid member having a first end and a second end, wherein said support structure is pivotably coupled to said rigid member at a pivot point between said first end and said second end.

7. The device according to claim 6, wherein said support structure includes a top member that is pivotably connected to said rigid member of said bracket structure, whereby said top member lays substantially parallel to said rigid member when said support structure is at said first orientation.

8. The device according to claim 7, wherein said at least one spring element is configured to include at least one leaf spring disposed on either side of said pivot point.

9. The device according to claim 6 wherein said at least one flexible element is configured as two flexible elements wherein one of said flexible elements is coupled to said first end and said second end of said rigid member, whereby said rigid member is suspended from a remainder of said bracket structure by said flexible elements.

10. The device according to claim 9, wherein said flexible elements are spring plates.

* * * * *